US005561407A

United States Patent [19]

Koscica et al.

[11] Patent Number: 5,561,407

[45] Date of Patent: Oct. 1, 1996

[54] SINGLE SUBSTRATE PLANAR DIGITAL FERROELECTRIC PHASE SHIFTER

[75] Inventors: Thomas E. Koscica, Clark; Richard W. Babbitt, Fairhaven; William C. Drach, Tinton Falls, all of N.J.

[73] Assignee: The United States of America as represented by the Secretary of the Army, Washington, D.C.

[21] Appl. No.: 381,782

[22] Filed: Jan. 31, 1995

[51] Int. Cl.[6] ..... H01P 1/18

[52] U.S. Cl. ..... 333/161; 333/164

[58] Field of Search ..... 333/161, 164

[56] References Cited

U.S. PATENT DOCUMENTS

| | | | |
|---|---|---|---|
| 4,931,753 | 6/1990 | Nelson et al. | 333/164 X |
| 5,032,805 | 7/1991 | Elmer et al. | 333/161 X |
| 5,307,033 | 4/1994 | Koscica et al. | 333/161 |
| 5,334,958 | 8/1994 | Babbitt et al. | 333/161 X |

*Primary Examiner*—Benny Lee

*Attorney, Agent, or Firm*—Michael Zelenka; William H. Anderson

[57] ABSTRACT

A phase shifter having a single or monolithic ferroelectric material and a plurality of ferroelectric transmission lines formed thereon, each having a different effective physical length and associated delay or phase shift. The plurality of different lengths of ferroelectric transmission lines has a voltage source associated therewith for applying a predetermined bias voltage, resulting in a change in permitivity in the ferroelectric substrate material. The different lengths of ferroelectric transmission line formed on the single substrate have a predetermined relationship between their effective physical linear lengths. By selectively activating the different lengths of ferroelectric transmission line by applying a bias voltage in different combinations, a desired or predetermined phase shift is obtained. The single or monolithic ferroelectric substrate used greatly reduces the overall length of the ferroelectric phase shifter. Additionally, less complex drive circuits are needed relative to analog type ferroelectric phase shifters.

13 Claims, 2 Drawing Sheets

SINGLE SUBSTRATE PLANAR DIGITAL FERROELECTRIC PHASE SHIFTER

GOVERNMENT INTEREST

The invention described herein may be manufactured, used, and licensed by or for the Government of the United States of America without the payment to us of any royalties thereon.

FIELD OF THE INVENTION

The present invention relates generally to microstrip phase shifters, and more particularly to a digital single ferroelectric element phase shifter.

BACKGROUND OF THE INVENTION

Ferroelectric phase shifters are used to control the phase of an electromagnetic wave such as a microwave or a millimeter wave signal. This changing of the phase or phase shifting makes possible the steering of an electromagnetic beam without physically moving an antenna. Phase shifters are extensively used in electronic scanning radar. An array of phase shifters are used to steer the electromagnetic wave front without any mechanical movement.

It is desirable to electronically control the phase shift that a given device can produce. One such device that provides a controlled variable phase shift is disclosed in U.S. Pat. No. 5,032,805 entitled "RF Phase Shifter" and issuing to Elmer et al on Jul. 16, 1991, which is herein incorporated by reference. Therein disclosed is a phase shifter made from a ceramic material, the permitivity of which may be varied by varying the strength of an electric field to which it is subjected or immersed. The phase shift is continuously varied by varying the applied voltage from a single source. This phase shifter, while providing variable phase shifts, requires a relatively complex voltage source with associated control circuits. Another phase shifter that reduces the control circuits previously required is disclosed in U.S. Pat. No. 5,307,033 entitled "Planar Digital Ferroelectric Phase Shifter" issuing to Koscica et al, the same inventors as the present invention, on Apr. 26, 1994, which is herein incorporated by reference. Therein disclosed is a planar stripline type ferroelectric phase shifter that has a plurality of series coupled independent ferroelectric phase shifting elements. Each element has a different length and is coupled to a separate voltage source for separately controlling each separate ferroelectric element. This results in a discrete phase shift for providing a desired cumulative phase shift. This digital ferroelectric phase shifter has the advantage of requiring less complex control or drive circuits. However, the physically separated lengths of ferroelectric material result in a relatively complex structure that is difficult and costly to fabricate.

While the above ferroelectric phase shifters have advanced the art, they are not appropriate in many applications. Therefore, there is a need for ferroelectric phase shifters that are simpler, and easier and less costly to fabricate and manufacture. Reducing the fabrication cost of each ferroelectric phase shifter is particularly important in view of the large numbers of ferroelectric phase shifters required in a typical array as used in an electronically scanning radar device.

SUMMARY OF THE INVENTION

The present invention comprises a ferroelectric phase shifter having a single or a monolithic ferroelectric element of a predetermined shape. The monolithic ferroelectric element has a plurality of conductors associated therewith. Each of the plurality of conductors produces a different effective physical length of ferroelectric elements. Each of the plurality of conductors is associated with a voltage source for applying either a zero voltage or a predetermined bias voltage. The permitivity of the resulting formed different effective physical lengths of ferrite elements is controlled by the plurality of voltage sources. A desired phase shift is obtained by selectively enabling separate different effective physical lengths of ferroelectric elements. The different effective physical lengths of ferroelectric elements are related such that a total or a composite phase shift of 360° can be obtained.

Accordingly, it is an object of the present invention to provide a ferroelectric digital phase shifter that is easy to manufacture or fabricate.

It is an advantage of the present invention that the overall length of a ferroelectric digital phase shifter is reduced.

It is a feature of the present invention that a single or monolithic ferroelectric material is used.

It is another feature of the present invention that from a single or monolithic ferroelectric material, a plurality of different effective physical lengths is obtained.

These and other objects, advantages and features will be readily apparent in view of the following more detailed description.

DETAILED DESCRIPTION OF THE INVENTION

Figure 1:
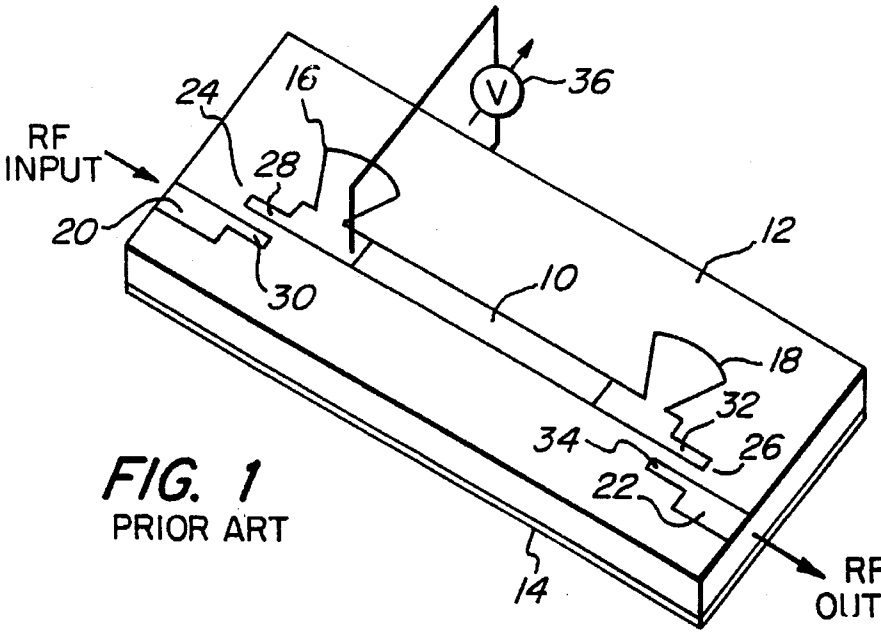
FIG. 1 PRIOR ART
FIG. 1 is a perspective view generally illustrating a conventional analog type ferroelectric phase shifter.

FIG. 1 illustrates a prior art or conventional planar analog ferroelectric phase shifter in the form of a stripline device. A ferroelectric material 10 having a predetermined length is fabricated on a ceramic substrate 12. The ferroelectric material 10 is typically barium-strontium titanate, $Ba_xSr_{1-x}TiO_3$ wherein x is less than 1. A metallic ground plane 14 is formed on the bottom surface of the planar ceramic substrate 12. At each end of the length of ferroelectric material 10 is placed impedance matching sections 16 and 18. Impedance matching sections 16 and 18 may be of the radial open circuit shunt stub type. The impedance matching sections 16 and 18 are coupled to an input microstrip element 20 and an output microstrip element 22, respectively. Between the impedance matching elements 16 and 18 and the input and output microstrip elements 20 and 22 are a pair of DC voltage blocks 24 and 26. DC voltage blocks 24 and 26 are comprised of relatively narrow strips 28, 30 and 32, 34, respectively which are mutually parallel and separated from each other a predetermined distance. Coupled to the ferroelectric material 10 is a variable voltage source 36 each designated by a voltage V. The variable voltage source 36 having a voltage V applies an electric field to the ferroelectric material 10 which results in a permitivity change in the ferroelectric material 10. This results in a phase shift or change in the resulting phase of the output from the phase of the input.

Figure 2:
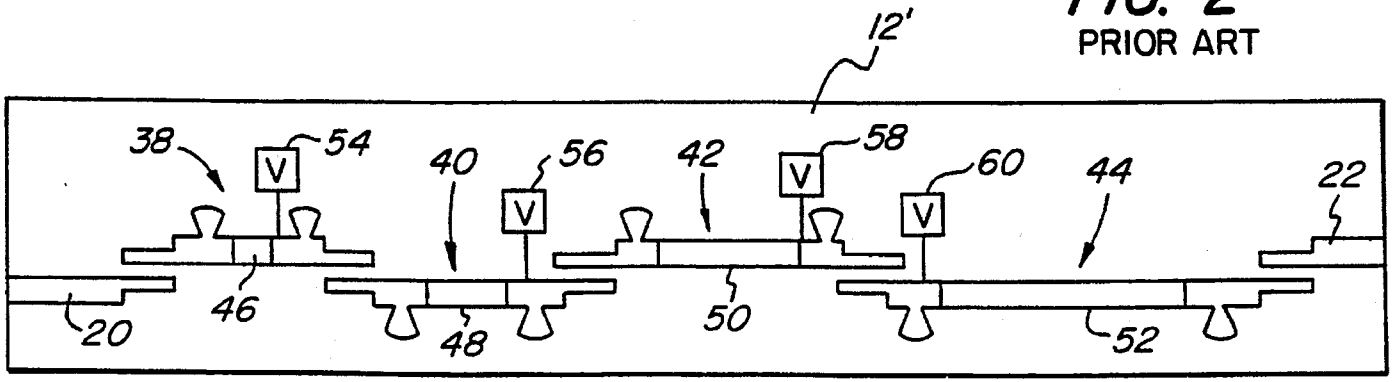
FIG. 2 PRIOR ART
FIG. 2 is a plan view of a digital ferroelectric phase shifter with physically separate ferroelectric elements.

FIG. 2 generally illustrates a prior art digital ferroelectric phase shifter. Formed on substrate 12' are four phase shifting elements 38, 40, 42, and 44. Phase shifting element 38 is coupled to the RF input microstrip element 20. Phase shifting element 44 is coupled to the output microstrip element 22. Each phase shifting element 38, 40, 42, and 44 is comprised of a separate length of ferroelectric material 46, 48, 50, and 52. The length of each separate ferroelectric material 46, 48, 50, and 52, respectively is different. Each length is associated with a different phase shift or delay. Voltage sources 54, 56, 58, and 60 (each designated by a voltage) are associated with each separate phase shifting element 38, 40, 42, and 44, respectively. The voltage sources 54, 56, 58, and 60 are set to either a zero voltage or a bias voltage. The delay or phase shift associated with each phase shifting element 38, 40, 42, and 44 is either activated or deactivated, depending upon the setting of the voltage sources 54, 56, 58, and 60. Depending upon the combination of phase shifting elements 38, 40, 42, and 44 enabled, a phase shift from 0° to 360° is possible.

Figure 3:
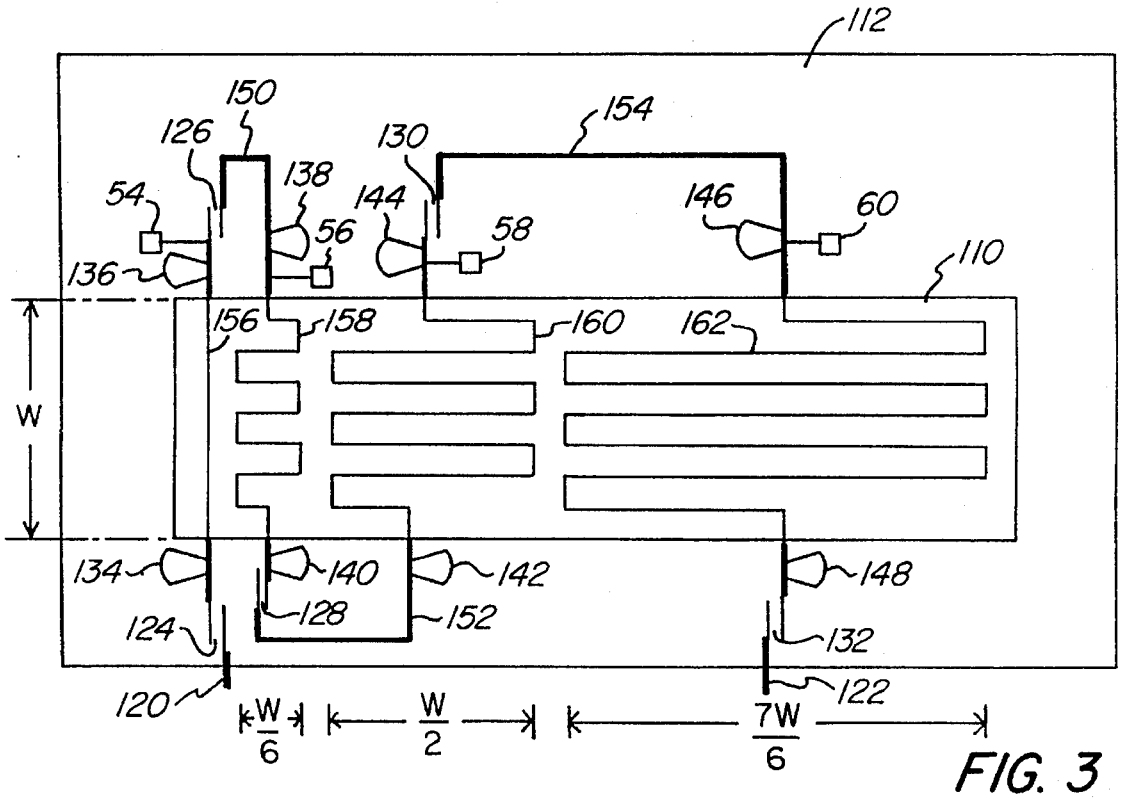
FIG. 3 is a plan view schematically illustrating one embodiment of the present invention.

FIG. 3 illustrates a digital ferroelectric phase shifter utilizing a single or monolithic ferroelectric material 110. The ferroelectric phase shifter has an input 120 and an output 122. The single or monolithic ferroelectric material 110 is fabricated onto a ceramic planar substrate 112. On the bottom surface of the planar ceramic substrate 112 is a metallic ground plane, not shown. The monolithic ferroelectric material 110 has a rectangular shape with a lateral width W. Associated with the rectangular monolithic ferroelectric material 110 are four conductors 156, 158, 160, and 162. The conductors 156, 158, 160, and 162 are formed on the monolithic ferroelectric material 110 so that their effective physical lengths have a predetermined relationship. For example, the effective physical length of conductor 162 is eight times that of the effective physical length of conductor 156. The effective physical length of conductor 160 is four times that of the effective physical length of conductor 156. The effective physical length of conductor 158 is twice that of the effective physical length of conductor 156. The effective physical length of conductor 158 is accomplished by traversing a longitudinal distance W/6 six times while traversing laterally across the rectangular ferroelectric material 110. Therefore, the effective physical length of conductor 158 is twice that of the effective physical length of conductor 156. Similarly, conductor 160 traverses a longitudinal length W/2 six times while laterally traversing the width of the rectangular ferroelectric material 110, resulting in an effective physical length of four times the effective physical length of conductor 156. Similarly, conductor 162 traverses a longitudinal distance 7W/6 six times while traversing laterally the width of rectangular ferroelectric material 110, resulting in an effective physical length of eight times the effective physical length of conductor 156. As a result, from a singular monolithic rectangular ferroelectric material 110, a plurality of transmission lines are formed that have different effective physical lengths. The effective physical lengths formed by conductors 156, 158, 160, and 162 are serially coupled together by conductors 150, 152, and 154. Associated with each conductor 156, 158, 160, and 162 are pairs of impedance matching elements 134 and 136, 138 and 140, 142 and 144, and 146 and 148 respectively. The DC voltage blocks 124, 126, 128, 130, and 132 are also associated with the ferroelectric phase shifter. Voltage sources 54, 56, 58, and 60 are respectively associated with each of the conductors 156, 158, 160, and 162 forming the effective physical lengths. While a plurality of voltage sources 54, 56, 58, and 60 are shown, a single voltage source that is selectively coupled to each of the conductors 156, 158, 160, and 162 or any combination of voltage sources that form the multiple transmission lines would be equivalent. When a bias voltage is applied to the selected conductor 156, 158, 160, and 162, a predetermined phase shift is obtained. For example, when a bias voltage is applied by voltage source 54, a 22.5° phase shift is obtained. When a bias voltage is applied by voltage source 56, a 45° phase shift is obtained, when a bias voltage is applied by voltage source 58, a 90° phase shift is obtained, and when a bias voltage is applied by voltage source 60, a 180° phase shift is obtained. If a phase shift between 45° and 90° is required, then by applying bias voltages 54 and 56, a 67.5° phase shift will occur. Likewise, when a phase shift greater than 180° is required, more than one voltage is necessary. For example for a 292.5° phase shift, voltages 60, 58 and 54 are required. Any composite desired phase shift can be obtained by selectively applying a bias voltage with voltage sources 54, 56, 58, and 60. Accordingly, the desired phase shift can be accomplished in digital fashion.

Figure 4:
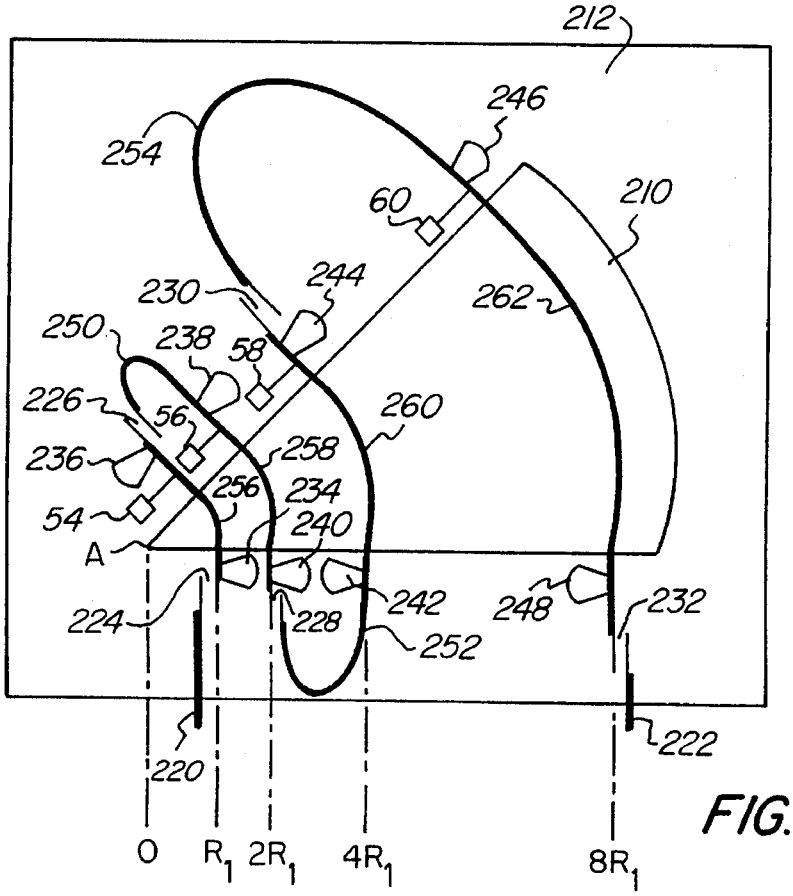
FIG. 4 is a plan view schematically illustrating another embodiment of the present invention.

FIG. 4 illustrates another embodiment of the present invention. In this embodiment, a triangular or wedge shaped single or monolithic ferroelectric material 210 is fabricated onto a planar ceramic substrate 212. On the bottom surface of substrate 212 is a metallic ground plane, not shown. A plurality of effective physical lengths on the monolithic ferroelectric material 210 are formed by conductors 256, 258, 260, and 262. Each of the conductors 256, 258, 260, and 262 are a circumferential portion positioned a predetermined radial distance from the vertex or point A of the monolithic ferroelectric material 210. For example, if conductor 256 is spaced a radial distance $R_1$ from point A, which corresponds with a starting point O conductor 258 is spaced a radial distance $2R_1$, and conductor 260 is spaced a radial distance $4R_1$, and conductor 262 is spaced a radial distance $8R_1$. The conductors 256, 258, 260, and 262 therefore form circumferential portions that each have an effective physical length proportional to their respective radial distance from point A. Associated with the conductors 256, 258, 260, and 262 are DC voltage blocks 224, 226, 228, 230, and 232, respectively. Impedance matching elements 234, 236, 238, 240, 242, 244, 246, and 248 are correspondingly associated with the conductors 256, 258, 260, and 262. Additionally, each of the conductors 256, 258, 260, and 262 have associated therewith a corresponding voltage source 54, 56, 58, and 60. The conductors 256, 258, 260, and 262 form different effective physical lengths that are coupled serially by conductors 250, 252, and 254. Each of the effective physical lengths formed by conductors 256, 258, 260, and 262 are enabled or activated by applying a bias voltage thereto with their respective voltage sources 54, 56, 58, and 60. The application of a bias voltage changes the permitivity of the portion of the monolithic ferroelectric material 210 associated with the respective conductors 256, 258, 260, and 262. Accordingly, the phase of an electromagnetic wave, such as a millimeter or microwave, entering RF input 220 is changed by selectively applying a bias voltage with voltage sources 54, 56, 58, and 60 to the respective conductors 256, 268, 260, and 262, such that the desired phase shift is achieved at the RF output 222. Accordingly, the desired phase shift can be accomplished in digital fashion.

Accordingly, the present invention, by utilizing a single or monolithic ferroelectric material of a predetermined shape provides a digital ferroelectric phase shifter that is easily manufactured or fabricated and which greatly reduces the overall length of the phase shifter. The binary weighted lengths of ferroelectric material created by the single or monolithic ferroelectric substrate additionally provides a digital type control. This greatly simplifies the voltage or drive circuits used with the present invention relative to those previously required in an analog type phase shifter.

Therefore, it should readily be appreciated that the present invention has many practical applications. Although the preferred embodiment has been illustrated and described, it will be obvious to those skilled in the art that various modifications may be made without departing from the spirit and scope of this invention.

What is claimed is:

1. A digital phase shifter comprising:

a substrate having a first substantially flat planar surface and an opposing second substantially flat planar surface;

a metallic ground plane disposed on the first substantially flat planar surface;

a single section of monolithic ferroelectric material disposed on the second substantially flat planar surface, said single section of monolithic ferroelectric material having a predetermined shape;

a plurality of transmission lines, comprised of a plurality of conductors disposed on said single section of monolithic ferroelectric material, each of said plurality of transmission lines having a different respective physical linear length, said plurality of transmission lines being serially coupled together; and a plurality of voltage sources respectively coupled to said plurality of transmission lines, each of said plurality of voltage sources selectively providing a bias voltage to a respective one of said plurality of transmission lines such that a predetermined phase shift is obtained from a first phase of an input electromagnetic signal to a second phase of a resulting output electromagnetic signal.

2. A digital phase shifter as in claim 1 wherein:

said plurality of transmission lines equals four in number.

3. A digital phase shifter as in claim 1 wherein:

said monolithic ferroelectric material is a barium-strontium titanate material.

4. A digital phase shifter as in claim 1 wherein:

the input electromagnetic signal has a wavelength in a millimeter wave region.

5. A digital phase shifter comprising:

a substrate;

a single section of monolithic ferroelectric material disposed on said substrate;

a plurality of transmission lines disposed on said monolithic ferroelectric material, each of said plurality of transmission lines having a different physical length, said plurality of transmission lines being electrically serially coupled together, wherein the different physical lengths of said plurality of transmission lines are an integral multiple of a predetermined length;

voltage source means for selectively providing an electric field to each of said plurality of transmission lines, wherein said voltage source means is electrically coupled to said plurality of transmission lines;

an electromagnetic wave input disposed on said substrate and electrically coupled to an input end of said plurality of transmission lines; and an electromagnetic wave output disposed on said substrate and electrically coupled to an output end of said plurality of transmission lines.

6. A digital phase shifter as in claim 5 wherein:

said single section of monolithic ferroelectric material has a lateral width and a longitudinal length and at least one of said plurality of transmission lines traverses the longitudinal length of said single section of monolithic ferroelectric material multiple times.

7. A digital phase shifter as in claim 5 wherein:

said voltage source means is a plurality of voltage sources electrically coupled to said plurality of transmission lines respectively.

8. A digital phase shifter comprising:

a substrate;

a single section of monolithic ferroelectric material disposed on said substrate;

a plurality of conductors disposed on and electrically associated with said single section of monolithic ferroelectric material, each of said plurality of conductors having a different physical length, one of said plurality of conductors having a shortest physical length, the other of said plurality of conductors having a respective physical length an integral multiple of the shortest physical length, said plurality of conductors being electrically serially coupled together;

voltage source means for selectively providing a respective electric field to each of said plurality of conductors, wherein said voltage source means is electrically coupled respectively to said plurality of conductors;

an electromagnetic wave input disposed on said substrate and electrically coupled to an input end of said plurality of conductors; and an electromagnetic wave output disposed on said substrate and electrically coupled to an output end of said plurality of conductors, wherein said serially connected plurality of conductors are a plurality of serially connected transmission lines that are selectively controlled to digitally provide a predetermined phase shift.

9. A digital phase shifter as in claim 8 wherein:

said single section of monolithic ferroelectric material is wedged shaped.

10. A digital phase shifter as in claim 8 wherein:

said single section of monolithic ferroelectric material is rectangular shaped.

11. A digital phase shifter as in claim 10 wherein:

said single section of monolithic ferroelectric material has a lateral width and a longitudinal length and all but one of said plurality of conductors traverses the longitudinal length of said single section of monolithic ferroelectric material multiple times.

12. A digital phase shifter comprising:

a substrate;

a single section of monolithic ferroelectric material disposed on said substrate, wherein said monolithic ferroelectric material is wedge shaped;

a plurality of transmission lines disposed on said monolithic ferroelectric material, each of said plurality of transmission lines having a different physical length, said plurality of transmission lines being electrically serially coupled together;

voltage source means for selectively providing an electric field to each of said plurality of transmission lines, wherein said voltage source means is electrically coupled to said plurality of transmission lines;

an electromagnetic wave input disposed on said substrate and electrically coupled to an input end of said plurality of transmission lines; and an electromagnetic wave output disposed on said substrate and electrically coupled to an output end of said plurality of transmission lines.

13. A digital phase shifter as in claim 12 wherein:

the wedge shape has a vertex, and a first one of said plurality of transmission lines is spaced a first radial distance from the vertex, and all other said plurality of transmission lines are spaced a respective radial distance equal to an integral multiple of the first radial distance.

* * * * *